US006085778A

United States Patent [19]

Bergmann

[11] Patent Number: 6,085,778

[45] Date of Patent: Jul. 11, 2000

[54] WALL CONNECTION

[75] Inventor: Konrad Bergmann, Schweich, Germany

[73] Assignee: Ideal-Standard GmbH, Bonn, Germany

[21] Appl. No.: 09/319,252

[22] PCT Filed: Dec. 9, 1997

[86] PCT No.: PCT/EP97/06868

§ 371 Date: Jun. 9, 1999

§ 102(e) Date: Jun. 9, 1999

[87] PCT Pub. No.: WO98/26133

PCT Pub. Date: Jun. 18, 1998

[30] Foreign Application Priority Data

Dec. 10, 1996 [DE] Germany ..... 196 51 313

[51] Int. Cl.[7] ..... F16K 51/00

[52] U.S. Cl. ..... 137/360; 251/152; 285/181; 285/412

[58] Field of Search ..... 251/148, 152, 251/181, 412

[56] References Cited

U.S. PATENT DOCUMENTS 5,110,157 5/1992 Chen ..... 285/8

5,555,909 9/1996 Elliott ..... 137/359

FOREIGN PATENT DOCUMENTS 67 51 160 9/1968 Germany .
20 64 002 7/1972 Germany .
26 37 251 2/1978 Germany .
30 41 712 5/1982 Germany .
37 11 429 10/1988 Germany .
40 33 043 5/1991 Germany .

*Primary Examiner*—A. Michael Chambers
*Assistant Examiner*—Thomas L. McShane
*Attorney, Agent, or Firm*—Nixon Peabody LLP; David S. Safran

[57] ABSTRACT

The invention relates to a wall connection for connecting a fitting (2) to a water network, with a connecting piece (3) having on the wall side a connection part (4) with an inlet duct (6), and on the fitting side a connection part (5) with an outlet duct (7). The inlet duct (6) and the outlet duct (7) are preferably excentrically staggered with regard to each other. In order to make a wall connection available for the connection of the fitting to the water network, in which the connection between the wall connection and the fitting takes up as little place as possible and is at the same time simple to produce, the invention provides that a flange (9) with tapped holes (12, 13) is provided for connecting the wall connection (1) to the fitting (2) by means of fastening screws (10, 11).

17 Claims, 2 Drawing Sheets

WALL CONNECTION

Figure 1:
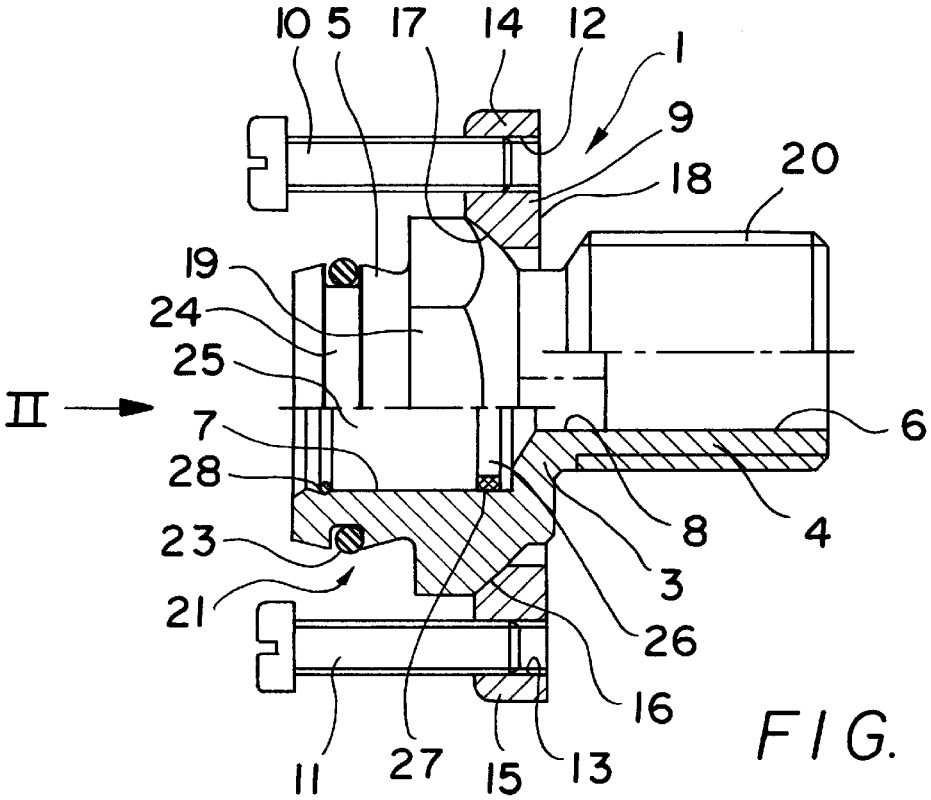

The invention relates to a wall supply for connection of a fitting to a water system, with a wall supply piece which has a wall-side supply part with an inlet channel and a fitting-side supply part with an outlet channel, the inlet channel and the outlet channel preferably being arranged eccentrically offset to one another.

Wall supplies are used to connect the hot and cold water installation lines of the water system to a fitting. Conventionally the inlet channel and the outlet channel in the wall supply piece are arranged axially parallel eccentrically offset to one another. In practice these wall supplies are therefore called "S-supplies". The eccentric arrangement of the inlet and outlet channel can balance inaccuracies in the distance of the supplies of the hot and cold water installation lines provided in the installation wall when mounting the fitting. By turning the pertinent wall supply pieces it is possible to mount the fitting exactly when the distance of the supplies of the installation lines deviates somewhat from the setpoint.

A water supply of the aforementioned type is already known from DE-U-67 51 160 and both on its wall side and also on its fitting-side supply part it has an outside thread for connection to the supplies of the installation lines or the fitting. Corresponding to the outside thread on the fitting-side supply part of the wall supply piece there is a union nut with an inside thread on the fitting on the hot and cold water delivery. The known screw connection between the wall supply and the fitting takes up a comparatively large amount of space as a result of the respective union nuts on the hot and cold water delivery so that a fitting which has been connected via a known wall supply projects accordingly away from the installation wall.

The object of this invention is to make available a wall supply for connection of a fitting to a water system, the connection between the wall supply and the fitting taking up as little space as possible and at the same time it can be easily produced.

This object is achieved as claimed in the invention in a wall supply of the initially mentioned type in that there is a flange which has threaded holes for connection of the wall supply to the fitting via mounting screws. Based on the aforementioned flange connection it is now possible for the connection between the wall supply and the fitting proceeding from the installation wall to have only a very small extension. This is especially advantageous if a fitting is to be made available which proceeding from the installation wall has only a very small construction depth. In addition to the small attainable construction depth of a fitting which has been connected via a wall supply as claimed in the invention, the flange connection moreover offers the advantage that it can be produced very easily, since to do so only two mounting screws need be screwed in.

Other features, advantages and possible applications of this invention follow from the dependent claims and the following description of embodiments using the drawings and the drawings themselves.

Figure 2:
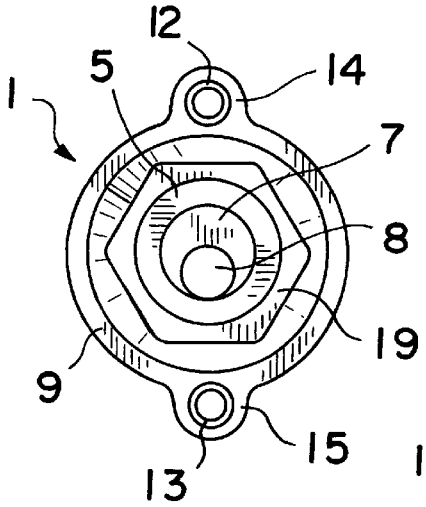
Figure 3:
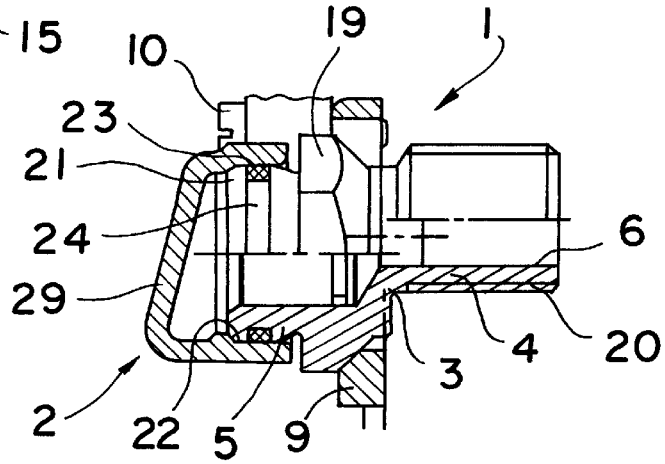
Figure 4:
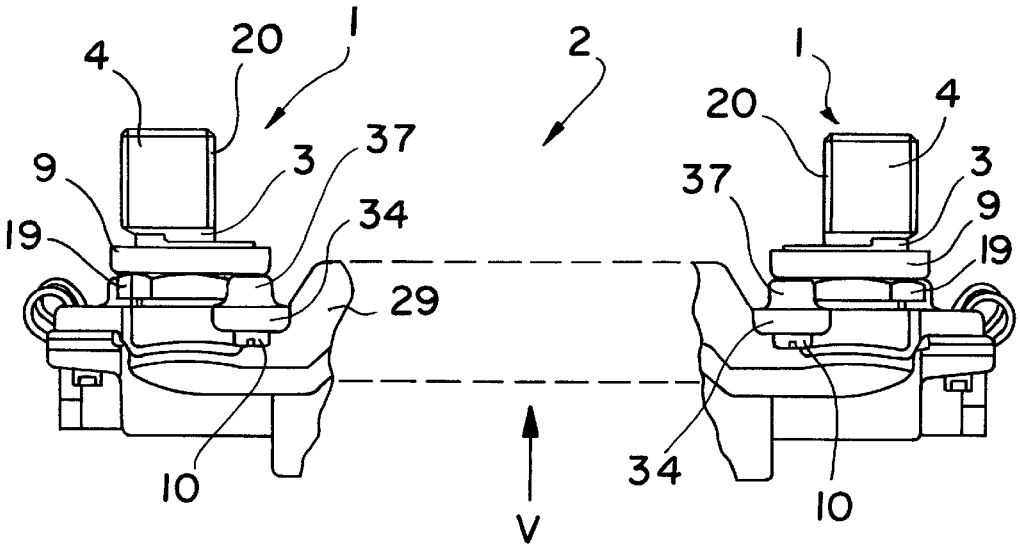
Figure 5:
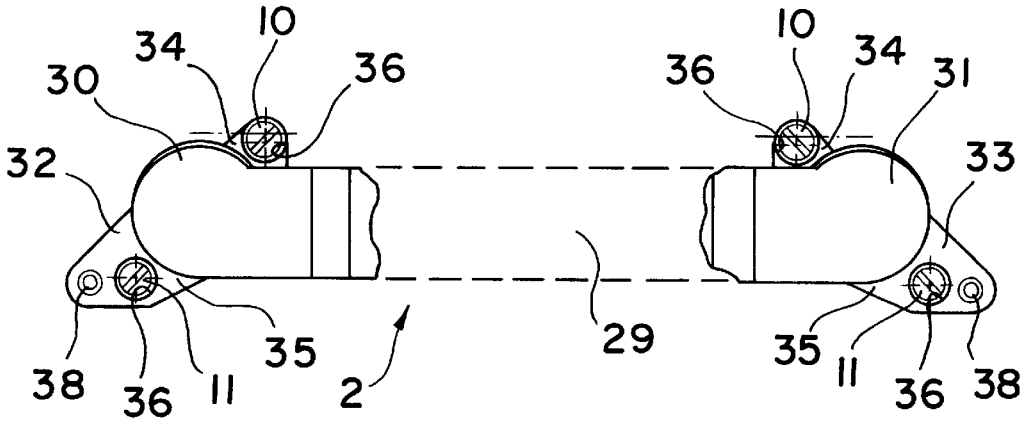

FIG. 1 shows a side view, partially in cross section, of a wall supply as claimed in the invention, FIG. 2 shows one view of the wall supply from FIG. 1 in the direction of the arrow II from FIG. 1, but without the mounting screws, FIG. 3 shows a side view of part of a fitting with a wall supply as claimed in the invention, FIG. 4 shows an overhead view of a fitting with two water supplies as claimed in the invention, and FIG. 5 shows a view of a fitting from FIG. 4 in the direction of the arrow V from FIG. 4.

The individual figures show a wall supply 1 for connection of a fitting 2 to a water system which includes the hot and cold water installation lines which are not shown here and which end in the corresponding supplies to which then the fitting 2 is connected via the wall supplies 1. The wall supply 1 itself has a wall supply piece 3 which is provided with a wall-side supply part 4 and a fitting-side supply part 5. In the wall-side supply part 4 there is an inlet channel 6, while in the fitting-side supply part 5 there is an outlet channel 7. The inlet channel 6 and the outlet channel 7 are arranged axially parallel eccentrically offset to one another and are interconnected via a through channel 8.

It is important at this point that the wall supply 1 in addition to the wall supply piece 3 has a flange 9 for connection to the fitting 2 via mounting screws 10, 11 which can be screwed into the corresponding threaded holes 12, 13 of the flange 9. As follows from FIG. 2, the flange 9 on opposite sides has one flange projection 14, 15 each in which there is one threaded hole 12, 13 respectively. Of course there can also be several flange projections. But to ensure a good connection of the fitting 2 and the wall supply 1 and to achieve an appropriate seal between the fitting 2 and the wall supply 1 the two flange projections 14, 15 with one threaded hole 12, 13 each are sufficient.

Advantageously the flange 9 can be turned relative to the wall supply piece 3. This means that the flange 9 is a separate component. In this embodiment the flange 9 is a ring which can be placed over the wall-side supply part 4. But fundamentally it is also possible for the flange to be made in one piece with the wall supply piece. The two-part configuration of the wall supply 1 with the flange 9 which can turn relative to the wall supply piece 3 however has the advantage of easy installation. The flange 9 is turned if necessary to the respective installation site and the connection between the fitting 2 and the wall supply 1 can then be established.

To be able to easily turn the flange 9 relative to the wall supply piece 3, both the flange 9 and also the wall supply piece 3 in a common contact area have spherical contact surfaces 16, 17 with roughly the same radius. These spherical contact surfaces 16, 17 between the flange 9 and the wall supply piece 3 yield a type of ball joint by which not only can the flange 9 move easily relative to the wall supply piece 3, but peripheral and flat transfer of force from the contact surface 17 of the flange 9 to the contact surface 16 of the wall supply piece 3 is good.

In this embodiment the flange 9 is located in the area of the fitting-side supply part 5 of the wall supply piece 3, specifically at the transition of the wall-side supply part 4 to the fitting-side supply part 5. This need not necessarily be the case, but with respect to the rotary arrangement of the flange 9 relative to the wall supply piece 3 it is a good idea since the peripheral contact surface 16 can be easily placed or formed in the transition area of the supply parts 4 and 5.

The back 18 of the flange 9 is essentially even. This has the advantage that the flange 9 can be screwed flat to the surface of the installation wall which is not shown here or of a tile of the installation wall. It is not shown that the flange on the wall supply piece can also be captively secured. In this case the wall supply composed of the flange and the wall supply piece then represents a unit, and the flange cannot be lost in spite of a their being separate.

On the fitting-side wall supply part 5 of the wall supply piece 3 there is a sexagon 19. Instead of the sexagon 19 there could of course be another tool engagement area. Via the sexagon 19 which is made in one piece with the wall supply piece 3 a screw connection between the wall supply 1 and the respective supplies of the hot and cold water installation lines which are not shown here can be easily established or broken. For this screw connection the wall-side supply part 4 in the conventional manner has an outside thread 20 for connection to the supply of the pertinent installation line, the supply not being shown.

While the wall-side supply part 4 is provided with an outside thread 20 for connection to the water system via the corresponding supplies, the fitting-side supply part 5 has a spherical head 21 for insertion into a corresponding receiver 22 of the fitting 2. In the installation state which is shown among others in FIG. 3 there is the spherical head 21 in the corresponding receiver 22 of the fitting 2 and seals there. For this reason in the area of the spherical head 21 there is a sealing element 23 in the form of an O-ring. The sealing element 23 is located in a peripheral groove 24 in the spherical head 21.

There is a nonreturn valve 25 here in the outlet channel 7. The nonreturn valve 25 on the outside in a peripheral groove 26 has a sealing element 27 while it is held securely in the outlet channel 7 via a locking ring 28. It goes without saying that the nonreturn valve could basically also be located in the inlet channel. Otherwise, instead of the nonreturn valve or in addition to it there can also be a damping insert for reducing noise in the outlet channel.

FIGS. 4 and 5 each show at least one part of the fitting 2 which is connected to the wall supplies 1. The fitting 2 has a fitting body 29 which is provided with a hot water delivery 30 and a cold water delivery 31. On the supply-side end of the hot water delivery 30 and the cold-water delivery 31 there is one connecting flange 32, 33 each, respectively. The connecting flanges 32, 33 are made in one piece with the fitting body 29. This is not however absolutely necessary. A configuration which can turn relative to the fitting body is also possible. In this case it is then not inherently necessary for the flange of the wall supply to be made as a separate part.

Each of the connecting flanges 32, 33 has two flange projections 34, 35 in which there is one hole 36 each. The holes 36 of each connecting flange 32, 33 are located on opposite sides and correspond to the threaded holes 12, 13 in the flanges 9 of the wall supplies 1. As is apparent from a comparison of FIGS. 4 and 5, the fitting 2 can be easily connected to the wall supplies 1 via the mounting screws 10, 11 via the connecting flanges 32, 33 of the fitting body 29 and the flanges 9 of the wall supplies 1. The embodiment of the wall supply 1 as claimed in the invention makes it possible for the wall supplies 1, i.e. the wall supply pieces 3 and also the flanges 9 for hot water delivery 30 and cold water delivery 31 to be made identical.

As follows from FIG. 4, between the projections 34 and the flange 9 there is one intermediate space each. The latter is bridged via a spacer 37 which in this embodiment is made in one piece with the projection 34. The same applies otherwise to the projection 35. FIG. 5 shows that the two projection 35 each have another hole 38. The holes 38 are used preferably for attaching other components of the fitting 2.

What is claimed is:

1. Wall supply for connection of a fitting (2) to a water system, with a wall supply piece (3) which has a wall-side supply part (4) with an inlet channel (6) and a fitting-side supply part (5) with an outlet channel (7), the inlet channel (6) and the outlet channel (7) being arranged offset to one another, and there being a flange (9) which has threaded holes (12, 13) and which can turn relative to the wall supply piece (3) for connection of the fitting (2) to the wall supply (1) via mounting screws (10, 11), characterized in that the wall supply piece (3) and the flange (9) each have spherical contact surfaces (16, 17) in a common contact area.

2. Wall supply as claimed in claim 1, wherein the inlet channel (6) and the outlet channel (7) are arranged eccentrically offset to one another.

3. Wall supply as claimed in claim 1, wherein the flange (9) is located in the area of the fitting-side supply part (5), preferably in the area of the transition from the wall-side supply part (4) to the fitting-side supply part (5).

4. Wall supply as claimed in claim 1, wherein the back (18) of the flange (9) facing the installation wall is essentially flat.

5. Wall supply as claimed in claim 1, wherein the flange is captively secured on the wall supply piece.

6. Wall supply as claimed in claim 1, wherein on the wall-side supply part (4) there is an outside thread (20) for connection to the water system and preferably in the area of the fitting-side supply part (5) there is a tool engagement area, especially in the form of a sexagon (19).

7. Wall supply as claimed in claim 1, wherein the fitting-side supply part (5) has a spherical head (21) for insertion into a corresponding receiver (22) of the fitting (2) and preferably there is at least one sealing element in the area of the spherical head (21).

8. Wall supply as claimed in claim 1, wherein there is a nonreturn valve (25) in the inlet channel or in the outlet channel (7) and preferably there is a damping element in the outlet channel.

9. Fitting with a fitting body (29) which has a hot water delivery (30) and a cold water delivery (31), on the supply-side end of the hot water delivery (30) and of the cold-water delivery (31) there being one connecting flange (32, 33) each, respectively, for connection to one wall supply (1) at a time as claimed in claim 1 via mounting screws (10, 11).

10. Fitting as claimed in claim 9, wherein the flanges (9) of the wall supplies (1) for connection to the connecting flanges (32, 33) of the hot water delivery (30) and of the cold-water delivery (31) are structurally identical.

11. Wall supply as claimed in claim 2, wherein the flange (9) is located in the area of the fitting-side supply part (5), preferably in the area of the transition from the wall-side supply part (4) to the fitting-side supply part (5).

12. Wall supply as claimed in claim 3, wherein the back (18) of the flange (9) facing the installation wall is essentially flat.

13. Wall supply as claimed in claim 4, wherein the flanges is captively secured on the wall supply piece.

14. Wall supply as claimed in claim 5, wherein on the wall-side supply part (4) there is an outside thread (20) for connection to the water system and preferably in the area of the fitting-side supply part (5) there is a tool engagement area, especially in the form of a sexagon (19).

15. Wall supply as claimed in claim 6, wherein the fitting-side supply part (5) has a spherical head (21) for insertion into a corresponding receiver (22) of the fitting (2) and preferably there is at least one sealing element in the area of the spherical head (21).

16. Wall supply as claimed in claim 7, wherein there is a nonreturn valve (25) in the inlet channel or in the outlet channel (7) and preferably there is a damping element in the outlet channel.

17. Fitting with a fitting body (29) which has a hot water delivery (30) and a cold water delivery (31), on the supply-side end of the hot water delivery (30) and of the cold-water delivery (31) there being one connecting flange (32, 33) each, respectively, for connection to one wall supply (1) at a time as claimed in claim 8 via mounting screws (10, 11).

* * * * *